US006419458B1

(12) United States Patent
Lower et al.

(10) Patent No.: US 6,419,458 B1
(45) Date of Patent: Jul. 16, 2002

(54) SUB SEA PILE-SUMP PUMPING ARRANGEMENT

(75) Inventors: Timothy Miles Lower; Simon Gerald Bailey Dawson, both of Berkshire (GB)

(73) Assignee: Mentor Subsea Technology Services, Inc., Houston, TX (US)

( * ) Notice: Subject to any disclaimer, the term of this patent is extended or adjusted under 35 U.S.C. 154(b) by 93 days.

(21) Appl. No.: 09/690,038

(22) Filed: Oct. 16, 2000

(30) Foreign Application Priority Data

Nov. 11, 1999 (GB) ..... 9926718

(51) Int. Cl.[7] ..... F04B 23/00

(52) U.S. Cl. ..... 417/313; 166/90.1; 405/231; 405/232; 405/248; 405/227; 417/424.1; 417/423.3

(58) Field of Search ..... 417/313, 424.1, 417/423.3; 166/366, 368, 90.1; 405/231, 232, 248, 227

(56) References Cited

U.S. PATENT DOCUMENTS

| | | | | | |
|---|---|---|---|---|---|
| 4,125,162 | A | * | 11/1978 | Groves, Sr. et al. | 166/314 |
| 4,423,780 | A | * | 1/1984 | Vigneri et al. | 166/308 |
| 4,456,069 | A | * | 6/1984 | Vigneri | 166/308 |
| 5,951,207 | A | * | 9/1999 | Chen | 405/232 |
| 6,230,810 | B1 | * | 5/2001 | Rivas | 166/357 |

* cited by examiner

*Primary Examiner*—Charles G. Freay
*Assistant Examiner*—William Rodriguez
(74) *Attorney, Agent, or Firm*—D. Neil LaHaye

(57) ABSTRACT

A pump 12 is (or pumps are) located in a blind foundation pile 14 that has been driven into the sea floor. The top of the pile 14 is provided with a fitting that includes an inlet 18, a hanger 24 for the pump 12, and an outlet 20. water is delivered from a filtering and treatment apparatus into the pile 14 through the inlet 18. The pump 12 delivers the water under pressure through the outlet 20 into piping that directs the water to the water injection well.

2 Claims, 2 Drawing Sheets

SUB SEA PILE-SUMP PUMPING ARRANGEMENT

BACKGROUND OF THE INVENTION

1. Field of the Invention

The invention is generally related to the production of oil and more particularly to the injection of water into an oil-bearing formation and the boosting of pressure of produced fluids for transportation.

2. General Background

In the production of oil, it is conventional practice to use water injection to maintain the pressure within the oil-bearing formation to assist and improve oil recovery.

Conventional water injection systems are deck mounted and typically include fine filtration, de-aeration, chemical treatment and pumps. The injection water is transported to the injection well(s) by pipeline.

It is, in some applications, considered acceptable to use minimally treated seawater to provide this pressure maintenance and there are potentially significant cost and operational advantages in positioning the injection pump adjacent to the water injection well.

Electric submersible pumps have been used for many pressure boosting applications and have a proven track record. These pumps are designed to be installed in the well bore. The disadvantage of this is that it increases the expense and risks associated with performing intervention tasks on the well.

For this reason it is considered advantageous to install the pump in a separate location (such as a pile) using the existing proven pump configuration.

SUMMARY OF THE INVENTION

The invention addresses the above need. What is provided is a pump located in a foundation pile that has been driven into the sea floor to support a seabed structure. The top of the pile is provided with a fitting that includes an inlet, a hanger (or hangers) for the pump (or pumps), and an outlet. Minimally treated seawater is delivered into the pile through the inlet. The pump delivers the water under pressure through the secondary piping and or, to the water injection well.

BRIEF DESCRIPTION OF THE DRAWINGS

For a further understanding of the nature and objects of the present invention reference should be made to the following description, taken in conjunction with the accompanying drawings in which like parts are given like reference numerals, and wherein.

DETAILED DESCRIPTION OF THE PREFERRED EMBODIMENT

CONFIGURATION 1—SINGLE PUMP ARRANGEMENT

Figure 1:
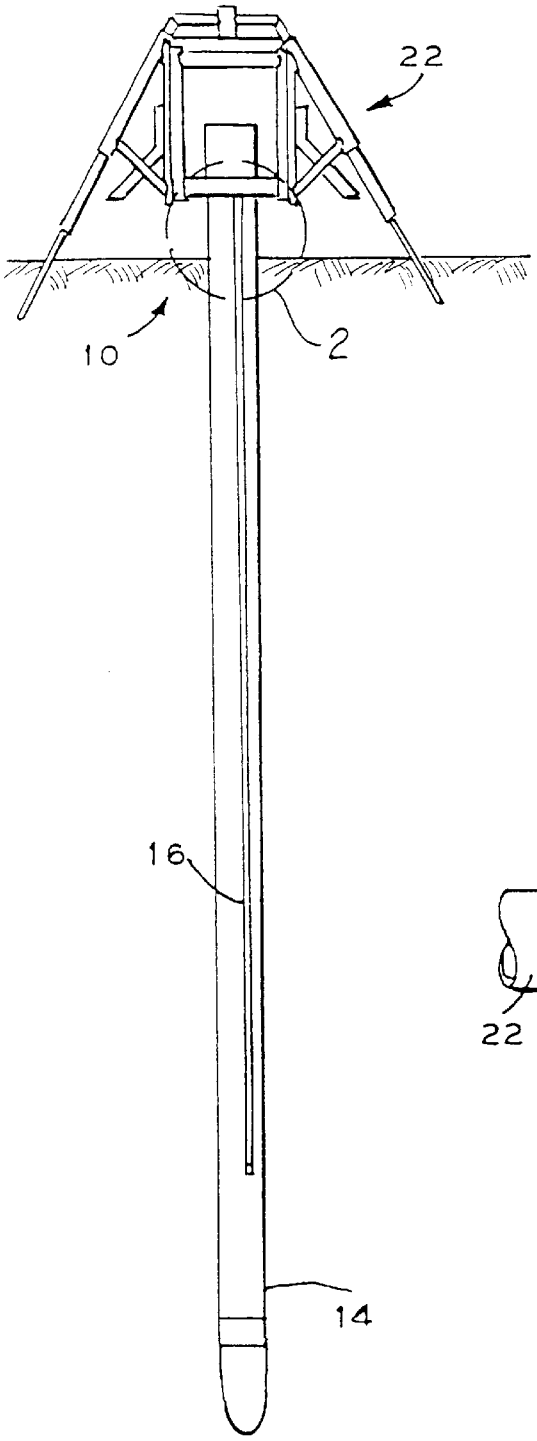
FIG. 1 is a side sectional view of the invention in single pump configuration.
Figure 2:
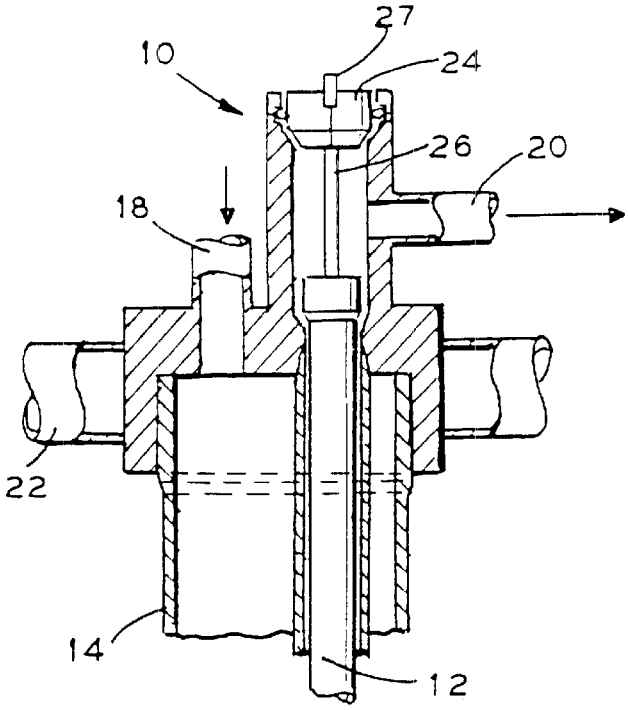
FIG. 2 is an enlarged view of the area indicated by the numeral 2 in FIG. 1.

Referring to the drawings, it is seen in FIG. 1 and 2 that the invention is generally indicated by the numeral 10. Sub sea pile-sump pumping arrangement 10 is generally comprised of a pump 12 provided in a foundation pile 14, tubing 16 housing the pump 12 within the pile 14, an inlet 18, and an outlet 20.

The foundation pile 14 is illustrated attached to item 22, which is the protective structure and support frame for the seawater filtration and treatment system.

Pump 12 is inserted in the foundation pile 14 and supported On place by hanger/collar 24 and tube 26. Electrical power to the pump is provided through electrical connection 27 and an electrical line housed in tube 26. Tubing 16 extends the length of the pump 12 into the lower end of the foundation pile 14. Appropriate electrical power and signal cables are run from the surface control station to the pump.

In operation, pumped fluid from a filtration and treatment apparatus not shown is drawn through inlet 18 into the foundation pile 14. Pump 12 is activated to deliver the pumped fluid through outlet 20 and on to the injection well.

CONFIGURATION 2—TWO PUMPS IN SERIES

Figure 3:
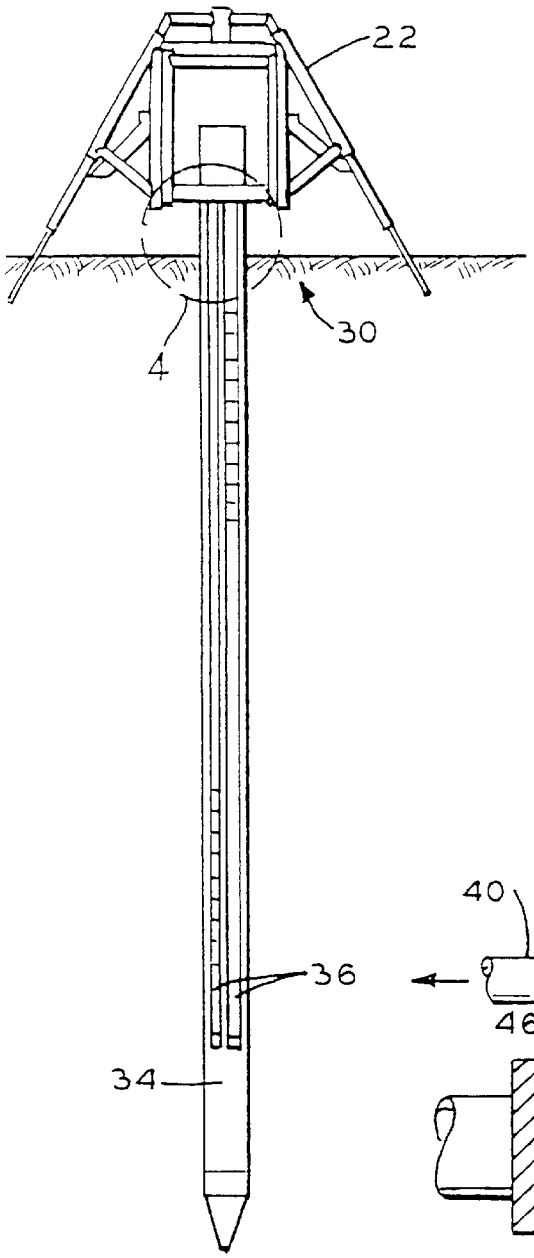
FIG. 3 is a side sectional view of the invention in series pump configuration.
Figure 4:
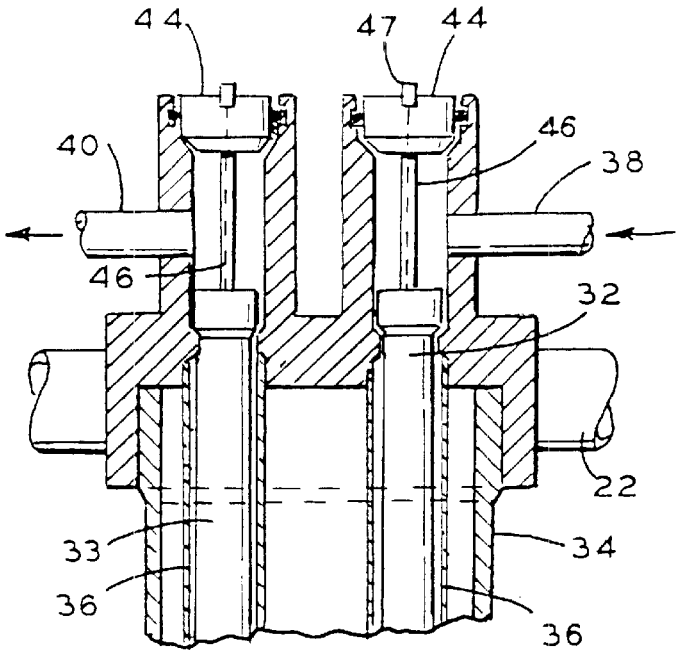
FIG. 4 is an enlarged view of the area indicated by the numeral 4 in FIG. 3.

FIG. 3 and 4 illustrate an alternate embodiment of the invention that is generally indicated by the numeral 30. In the alternate arrangement 30, two pumps 32 and 33 are installed in series on hangers 44 in a foundation pile 34. Tubing 36 houses the pumps 32 and 33 within the pile 34. An inlet 38 and an outlet 40 are provided as described above. Electrical power to the pumps is provided through electrical connection 47 and an electrical line housed in tubes 46.

By installing two electric submersible pumps in series, the pressure output capacity of the system can be increased. The ability to increase the pressure is the specific feature of this configuration.

The current pressure increase available from a "standard" electric submersible pump is approximately 240 bar (limited by motor size, the drive shaft capacity, the number of pump stages and the burst strength of the pump casing). In order to achieve pressures greater than this, the pile can be used as an intermediate pressure chamber to enable two similar electric submersible pumps to be connected in series. Both pumps are installed in the pile—the first pump (connected to the inlet) discharging into the pile and the second pump (connected to the outlet) pumping from the pile, thereby achieving double the pressure rise. The second pump does not exceed its casing burst pressure since it is operating within a pressurized environment—the pressure being supplied by the first pump—and the differential pressure therefore remains within normal limits.

The advantages of this arrangement are that two similar pumps of existing design can be combined to generate much greater pressures than would otherwise be possible.

COMMON FEATURES

The pile 14 can be of corrosion resistant material or the interior of the pile 14 can be lined to protect it from corrosion.

The invention provides the advantage of not having the pump installed in the well bore. This reduces the expense and risks associated with performing intervention tasks on the well. The use of an electric submersible pump provides potential cost advantages over a pump located on the seabed. The electric submersible pump is generally less expensive than the equivalent seabed mounted pump, has a more proven track record, and uses otherwise unoccupied space in the foundation pile and as a result potentially reduces the footprint, and therefore the size and weight, of the seabed equipment.

The invention is also suitable for any liquid pressure boosting application and low gas multiphase fluids.

The output flow rate can be increased by installing parallel systems within an appropriately sized pile. For low-pressure applications, single pumps would be mounted in parallel and for high-pressure applications, series pairs of pumps would be mounted in parallel.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed is:

1. A sub sea pile-sump pumping arrangement in a sub sea structure for pumping fluid into an oil-bearing formation to boost the pressure of produced fluids where a foundation pile is driven into the seabed, the pumping arrangement comprising:

a pump received in a blind foundation pile of the sub sea structure, with the pile providing pressure containment;

an inlet for directing non-produced fluid into the foundation pile; and an outlet for directing the pumped fluid out of the foundation pile and into the oil-bearing formation.

2. A sub sea pile-sump pumping arrangement in a sub sea structure for pumping fluid into an oil-bearing formation to boost the pressure of produced fluids where a foundation pile is driven into the seabed, the pumping arrangement comprising:

at least two pumps received in a blind foundation pile of the sub sea structure, with the pile providing pressure containment;

a two stage pumping arrangement where one pump provides a pressurized environment for the second pump;

an inlet for directing non-produced fluid into the foundation pile; and an outlet for directing the pumped fluid out of the foundation pile and into the oil-bearing formation.

* * * * *